US006439124B1

(12) United States Patent
Enlow et al.

(10) Patent No.: US 6,439,124 B1
(45) **Date of Patent: *Aug. 27, 2002**

(54) LEAD-FREE TIN PROJECTILE

(75) Inventors: Keith E. Enlow, Ofallon; Morris C. Buenemann, Jr., Florissant, both of MO (US)

(73) Assignee: Olin Corporation, East Alton, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/479,977

(22) Filed: Jan. 10, 2000

Related U.S. Application Data

(63) Continuation-in-part of application No. 08/993,458, filed on Dec. 18, 1997, now Pat. No. 6,016,754.

(51) Int. Cl.[7] ..... F42B 12/74

(52) U.S. Cl. ..... 102/501; 102/448; 420/557

(58) Field of Search ..... 102/501, 448, 102/439, 507–510, 514–517; 420/557, 560, 561, 562

(56) References Cited

U.S. PATENT DOCUMENTS

| | | | | | |
|---|---|---|---|---|---|
| 1,062,919 | A | | 5/1913 | Johnson | 102/509 |
| 1,715,788 | A | | 6/1929 | Rousseau | 102/509 |
| 3,003,420 | A | | 10/1961 | Nosler | 102/508 |
| 3,138,102 | A | * | 6/1964 | Meyer et al. | 102/509 |
| 4,417,521 | A | * | 11/1983 | Dahlitz | 102/501 |
| 4,811,666 | A | | 3/1989 | Lufty | 102/501 |
| 5,279,787 | A | | 1/1994 | Oltrogge | 419/38 |
| 5,385,100 | A | | 1/1995 | Corzine et al. | 102/507 |
| 5,385,101 | A | | 1/1995 | Corzine et al. | 102/509 |
| 5,399,187 | A | | 3/1995 | Mravic et al. | 102/517 |
| 5,415,944 | A | | 5/1995 | Kazem-Goudarzi et al. | |
| 5,443,010 | A | * | 8/1995 | Dahlitz | 102/501 |
| 5,500,183 | A | | 3/1996 | Noordegraaf et al. | 102/501 |
| 5,679,920 | A | | 10/1997 | Hallis et al. | 102/506 |
| 5,760,331 | A | | 6/1998 | Lowden et al. | 102/506 |
| 6,016,754 | A | * | 1/2000 | Enlow et al. | 102/516 |

FOREIGN PATENT DOCUMENTS

| | | | |
|---|---|---|---|
| GB | 1110507 | 4/1968 | 102/514 |
| GB | 2279440 | 1/1995 | 102/501 |
| WO | WO 96/01407 | 1/1996 | F42B/12/02 |
| WO | WO 97/43456 | 11/1997 | C22C/13/02 |
| WO | WO 99/31454 | 6/1999 | |

OTHER PUBLICATIONS

Winchester Ammunition 1998 Product Guide, Olin Corporation, 1998, p. 24.

*ASM® Handbook*, vol. 2, Properties and Selection: Nonferrous Alloys and Special–Purpose Materials, pp. 517–526 and 1250–1256, Jan. 1992.

U.S. Department of the Interior, Fish and Wildlife Service, Biological Report 10, "Zinc Hazards to Fish, Wildlife, and Invertebrates: A Synoptic Review" by Eisler, Apr. 1993.

*Tin and Its Alloys*, edited by Ernest S. Hedges, et al, pp. 64–68, 1960.

*F.B.I. Ammunition Test Protocol*, FBI, Dept. of Justice. *192 Ammunition Tests*, Apr. 1993, Firearms Training Unit, FBI Academy, Quantico, Virginia.

* cited by examiner

*Primary Examiner*—Harold J. Tudor
(74) *Attorney, Agent, or Firm*—Wiggin & Dana, LLP

(57) ABSTRACT

There is provided a lead-free projectile suitable for use as a bullet to be fired from a pistol or rifle or as a slug to be fired from a shotgun. The projectile core is formed from a high purity tin and has deformation properties similar to that of lead based projectiles without the environmental hazards associated with lead.

7 Claims, 5 Drawing Sheets

LEAD-FREE TIN PROJECTILE

CROSS REFERENCE TO RELATED PATENT APPLICATION

This patent application is a continuation in part of U.S. patent application Ser. No. 08/993,458 entitled, "Lead-Free Tin Projectile" that was filed on Dec. 18, 1997. Now U.S. Pat. No. 6,016,754 patent application Ser. No. 08/993,458 is incorporated by reference in its entirety herein.

BACKGROUND OF THE INVENTION

1. Field of the Invention

This invention relates to lead-free projectiles fired from rifles, pistols and shotguns. More particularly, a projectile having an essentially pure tin core exhibits performance characteristics similar to lead without presenting the environmental hazards of lead.

2. Description of Related Art

Most bullets fired from pistols and rifles have a lead base alloy core, meaning the core is either entirely or more than 50%, by weight, lead. The environmental hazards of lead are well known. Lead containing bullets fired into the ground are suspected to cause ground water pollution through leaching. Another problem facing shooters is that when a bullet having exposed lead is fired, a lead-containing dust from the projectile is emitted. These lead fumes are toxic and, if inhaled, present a hazard to the shooter. An additional hazard, lead is leached into ground water from unrecovered bullets.

Many alternatives to a lead core bullet have been disclosed. U.S. Pat. No. 5,399,187 to Mravic et al. discloses a sintered bullet core formed from a combination of a material having a density less than lead and a second material having a density greater than lead. One disclosed combination is a mixture of tin and tungsten.

U.S. Pat. No. 5,500,183 to Noordegraaf et al. discloses a non-jacketed bullet formed from a tin base alloy that contains as an alloy addition one or more of copper, antimony, bismuth and zinc. The bullet has a hardness on the order of at least 14 Brinell. Eutinal, a zinc-aluminum-magnesium alloy, is added to the tin base alloy to enhance ductility.

U.S. Pat. No. 5,679,920 to Hallis et al. discloses jacketed bullets having a core formed from twisted and swaged strands of zinc wire.

GB 2,279,440 discloses a projectile, pellet or bullet, for an air, gas or spring gun. The projectile may be formed from zinc, zinc alloy, copper, tin, bismuth or brass provided that the projectile forming metal is harder than lead or a lead alloy, but soft enough not to score the barrel bore.

While the projectiles disclosed in the above patents are lead-free, the cores of these projectiles are harder than lead causing the projectiles to have an unacceptable degree of ricochet. In addition, zinc containing cores may also pose an environmental hazard. Zinc fumes are noted in the *ASM Handbook,* Volume 2, as suspected to have a detrimental effect on health.

There remains, therefore, a need for a projectile that is both lead-free and zinc-free and has performance characteristics similar to that of a projectile with a lead base core. Among the performance characteristics of lead that enhance bullet performance are malleability, density and low cost.

SUMMARY OF THE INVENTION

Accordingly, it is an object of the invention to provide a lead-free projectile with upset characteristics similar to that of lead without the environmental hazards of lead. It is a feature of the invention that, in one embodiment, the projectile has an essentially pure tin core surrounded by a copper alloy jacket. In alternative embodiments, the essentially pure tin core is not jacketed.

Among the advantages of the invention are that the projectile has upset characteristics similar to that of lead and, by being lead-free, has a reduced impact on the environment. The projectiles are suitable for all types of bullets, jacketed or not, including pistol and rifle. The projectiles of the invention are useful for soft point, partition, and hollow point bullets, as well as other bullet configurations. The projectiles are also useful as slugs for shotguns.

In accordance with the invention, there is provided a lead-free projectile. The lead-free projectile has a metallic jacket with an outer surface defining an aerodynamic projectile and an inner surface defining at least one cavity. The at least one cavity is filled with essentially pure tin that has a yield strength that is equal to or less than 11 MPa.

The above stated objects, features and advantages will become more apparent from the specification and drawings that follow.

IN THE DRAWINGS

Figure 6:
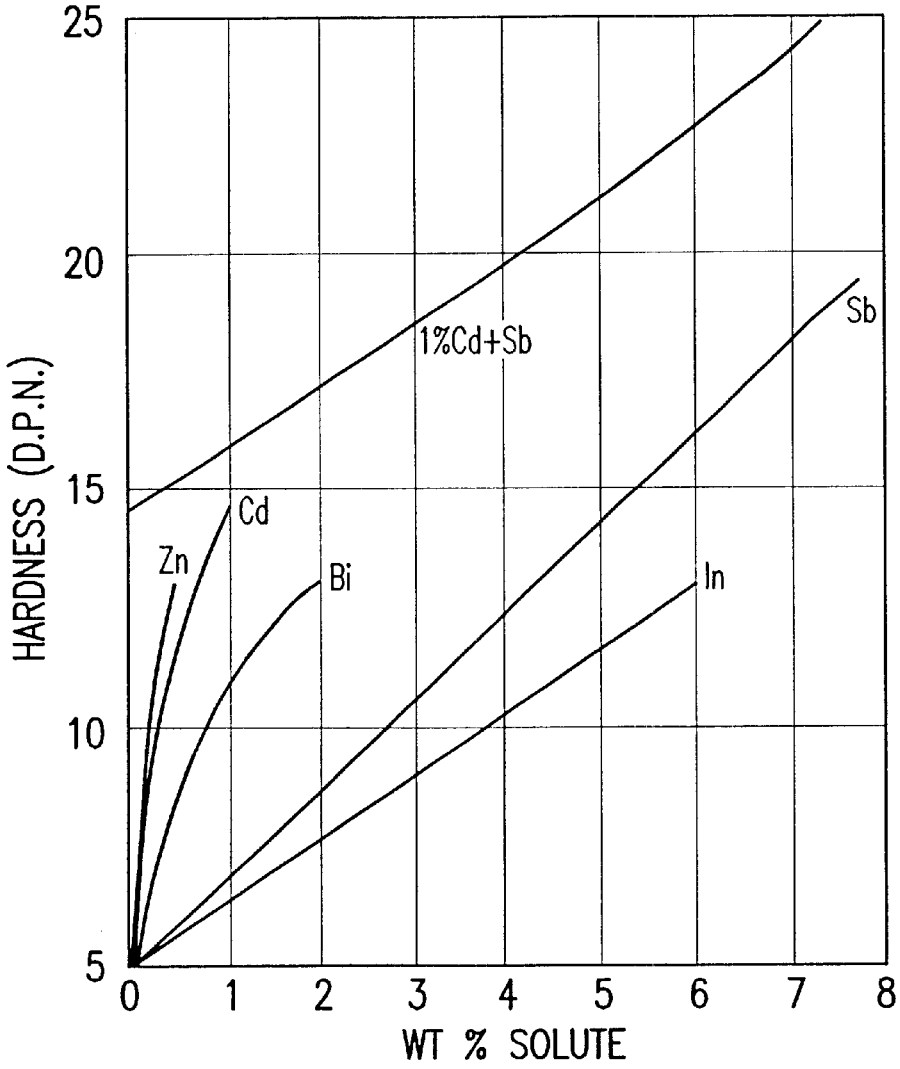
FIG.6 PRIOR ART

FIG. 6 graphically illustrates how small additions of alloying elements to tin greatly increase the hardness of the metal.

Figure 7:
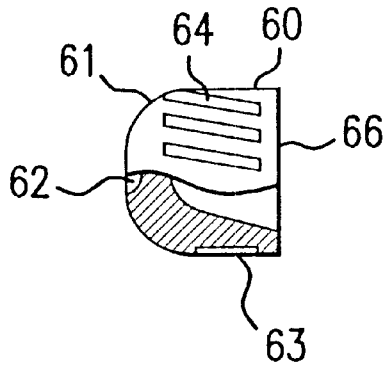

FIG. 7 illustrates a cup-shaped projectile for use with a shotgun in accordance with the invention in partial perspective and partial cross-sectional view.

Figure 8:
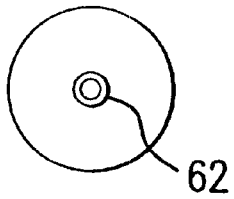

FIG. 8 illustrates the cup-shaped projectile of FIG. 7 in top planar view.

Figure 9:
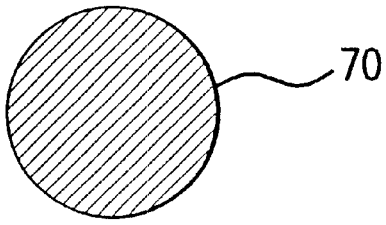

FIG. 9 illustrates in cross-sectional representation a spherical projectile for use with a shotgun in accordance with the invention.

DETAILED DESCRIPTION

The projectiles of the invention are intended to be expelled from a gun, rifle, or the like and propelled by detonation of a powdered chemical propellant.

Figure 1:
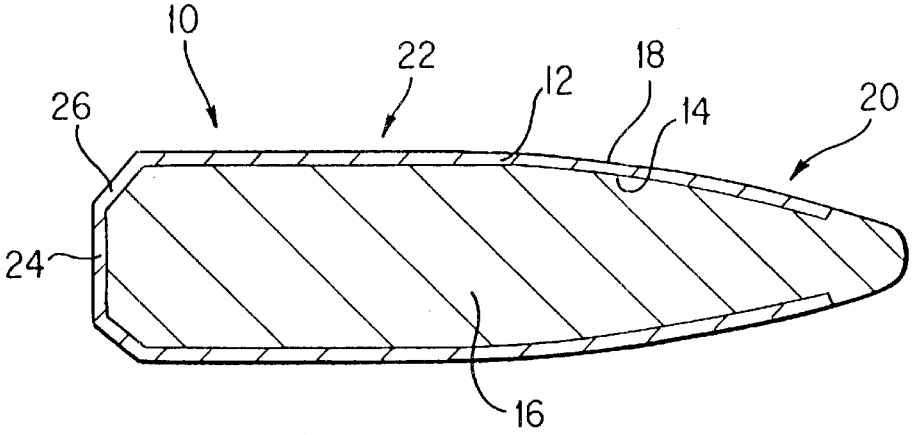
FIGS. 1 and 2 illustrate in cross-sectional representation rifle bullets in accordance with the invention.

With reference to FIG. 1, a projectile 10 in accordance with a first embodiment of the invention has a metallic jacket 12. The metallic jacket 12 has an inner surface 14 defining at least one cavity that is filled with a core material 16 that is lead-free. Lead-free, is intended to mean that lead is not intentionally added as an alloying addition. While, from an environmental stand-point, zero lead is desired, incidental lead impurities, in an amount of up to 0.05%, by weight, is within the scope of the invention. A preferred core material 16 is essentially pure tin.

An outer surface 18 of the metallic jacket 12 has an aerodynamic profile. Typically, the outer surface is generally cylindrical in shape with an inwardly tapered frontal portion 20, a central body portion 22 of substantially constant diameter and a heel portion 24 is generally perpendicular to the body portion 22. A transition portion 26 between the body portion 22 and heel portion 24 may be a relatively tight radius, or, as illustrated in FIG. 1, a tapered portion, referred to as a boat tail.

The metallic jacket 12 is formed from any suitable material such as copper, aluminum, copper alloys, aluminum alloys or steel. Copper base alloys containing zinc are preferred with a copper gilding alloy (nominal composition by weight of 95% copper and 5% zinc) being most preferred.

The core material 16 is formed from a metal having deformability characteristics similar to that of lead. Lead alloy L50042 (nominal composition by weight, 99.94% lead minimum) has a yield strength of between 12 and 14 MPa. Grade A pure tin (defined by American Society for Testing and Materials (ASTM) specification B 339 as having nominal composition by weight of 99.85% tin minimum and defined by U.S. government specification QQT-371 as having a nominal composition by weight of 99.75% tin minimum) has a yield strength of 11.0 MPa. Preferably, the metallic cores of the invention have a yield strength that is 11 MPa or less and, preferably, the yield strength is from about 8 MPa to about 11 MPa. Broadly, the hardness is less than 20 HB, more narrowly less than 5 HB, and preferably, from about 3 to about 5 HB.

As illustrated in Table 1, small additions of most alloying elements increase the yield strength and hardness of a tin base core. The less deformable the core, the greater the risk of ricochet.

TABLE 1

| Common Name | Composition in Weight Percent | Yield Strength in (MPa), Hardness in HB |
|---|---|---|
| Grade A - pure tin | 99.85% Sn Minimum | 11.0 MPa/3.9 HB |
| Antimonal - tin solder | 4.5%–5.5% Sb<br>Sn - balance | 40.7 MPa |
| Tin - silver solder | 4.4–4.8% Ag<br>Sn - balance | 31.7 MPa |
| Pewter | 1–8% Sb<br>0.25–3% Cu<br>Sn - balance | 55 MPa/8.7 HB |
| White metal | 92% Sn - 8% Sb | 48 MPa/18.5 HB |
| Hard tin | 99.6% Sn - 0.4% Cr | 23 MPa |
| Tin foil | 92% Sn - 8% Zn | 60 MPa |

FIG. 6, from Tin and Its Alloys edited by Hedges (1960), graphically illustrates how small additions of alloying elements to tin greatly increase the hardness of the metal.

A preferred metallic core 16 is essentially pure tin. The tin base core has a maximum, by weight, of 0.25% in total of alloying additions and no more than 0.2%, by weight, of any one alloying addition. More preferably, the total amount of all alloying additions is less than 0.15%, by weight, with no more than 0.1%, by weight, of any one alloying addition. Certain elements suspected to generate toxic fumes or to cause environmental hazards should be present in lesser amounts. As delineated in the *ASM Handbook,* at Volume 2, these detrimental additions include arsenic, lead, cadmium and zinc. Each detrimental addition is preferably present in an amount, by weight, of less than 0.005% and, more preferably, in an amount of less than 0.002%.

A preferred material for the metallic core is Grade A tin. As specified by the ASTM, this metal has as maximum residual impurities of 0.04% antimony, 0.05% arsenic, 0.030% bismuth, 0.001% cadmium, 0.04% copper, 0.015% iron, 0.05% lead, 0.01% sulfur, 0.005% zinc and 0.01% (nickel+cobalt).

The essentially pure tin is heated to above its melting temperature and molten metal poured into a cup-shaped jacket precursor. The jacket precursor is then mechanically swaged to a desired jacket shape. FIG. 1 illustrates a projectile 10 suitable as a jacketed soft point rifle bullet. The density of tin, 7.17 grams per centimeter$^3$, is about 63% that of lead, 11.35 gm/cm$^3$. Therefore, the projectiles of the invention have a weight that is lower than the weight of a lead cored projectile of equivalent dimensions. The reduced weight does not significantly degrade the performance of pistol bullets intended for short range use. For rifle bullets, a minor increase in bullet length will achieve a bullet weight similar to a lead core projectile. For example, a 5.56 millimeter copper jacketed soft point projectile, of the type illustrated in FIG. 1, has a nominal length of 0.675 inch and full weight of 55 grain when formed from lead. By increasing the length to 0.825 inch, a projectile with an essentially pure tin core achieves the same weight.

Figure 2:
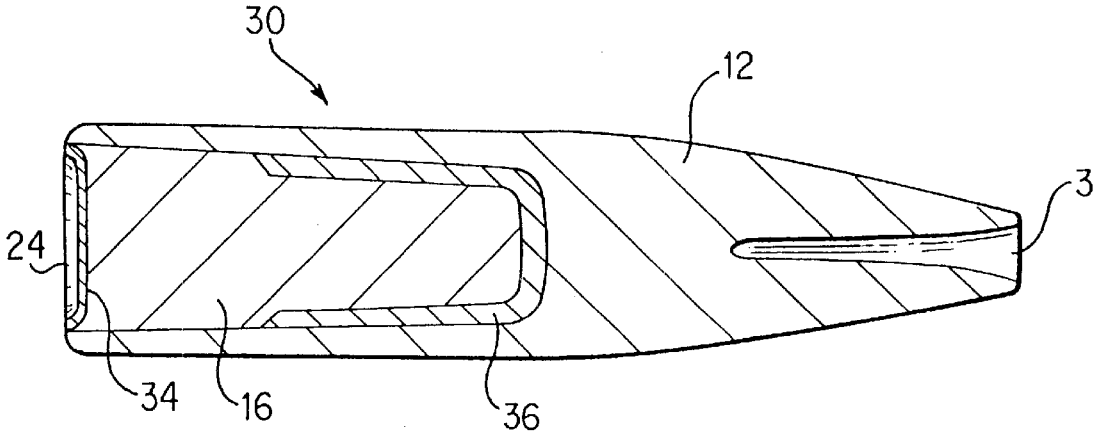

FIG. 2 illustrates a second projectile 30 useful as a rifle bullet. The projectile 30 has a partition design with a hollow point nose 32 formed from a metallic jacket 12. The metallic jacket 12 defines a rearward cavity filled with essentially pure tin 16. A closure disk 34, typically formed from brass, is press-fit into the heel portion 24 of the projectile 30 to prevent the extrusion of tin when the projectile is rapidly accelerated during firing.

Optionally, one or more cup-shaped inserts 36 are disposed between the essentially pure tin 16 and the hollow point nose 32. As disclosed in U.S. Pat. No. 5,385,101 to Corzine et al., that is incorporated by reference in its entirety herein, the cup-shaped insert 36, or multiple inserts, minimize the extrusion of metallic material from the cavity into a game animal struck by the projectile 30. The integrity of the metallic jacket 12 may be breached by impact with bone, or other hard structure, or pierced by petalled tips of the hollow point nose. The cup-shaped inserts 36 provide extra strength to prevent the loss of the core material.

Figure 3:
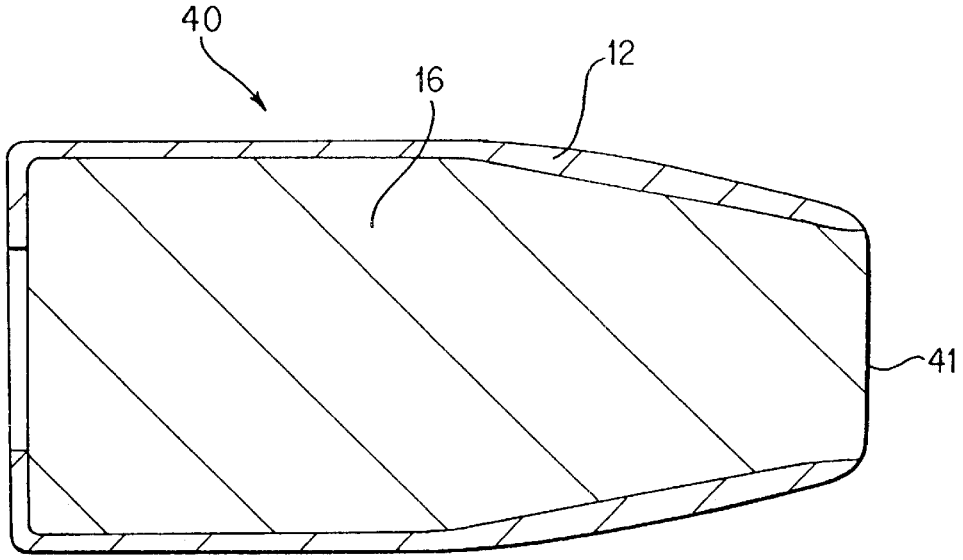
FIGS. 3–5 illustrate in cross-sectional representation pistol bullets in accordance with the invention.
Figure 4:
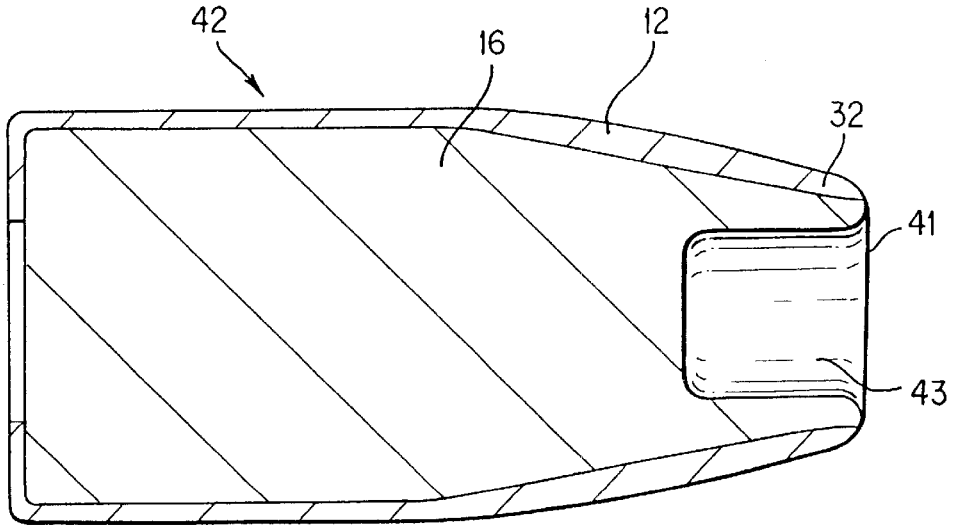
Figure 5:
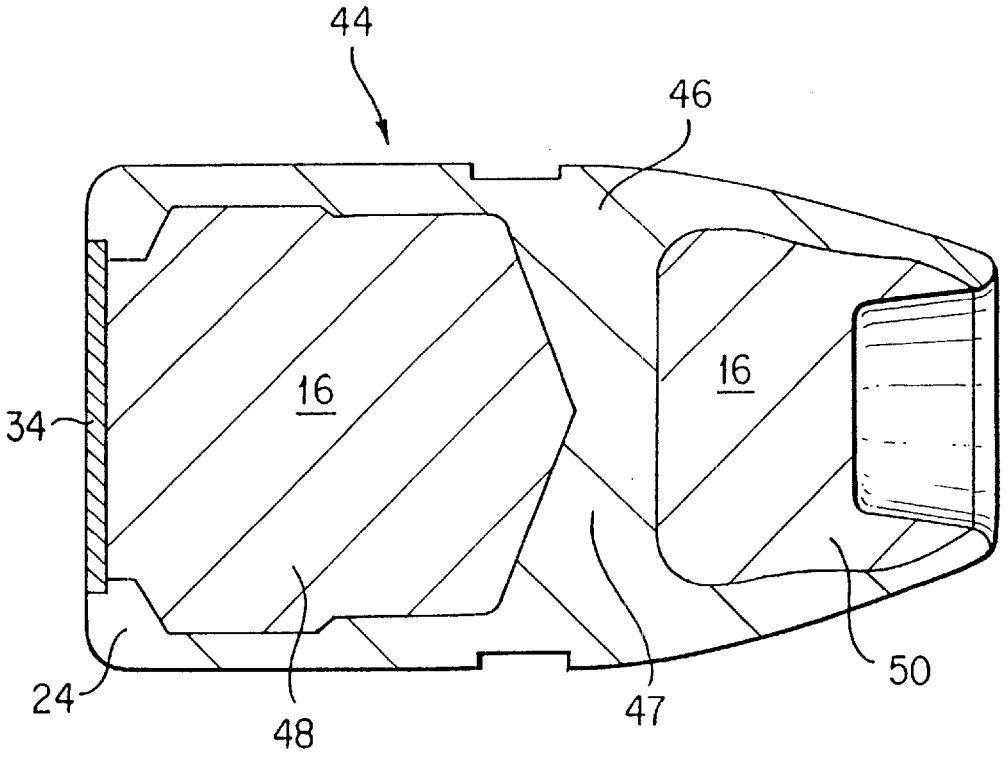

FIGS. 3–5 illustrate projectiles of the invention suitable for firing from a pistol. FIG. 3 illustrates a projectile 40 referred to as a jacketed soft point pistol bullet. The nose portion 41 is formed from essentially pure tin. Exemplary calibers for the projectile 40 are a 9 millimeter Luger jacketed soft point projectile, 38 Special jacketed soft point projectile, 40 S&W jacketed soft point projectile, 45 Auto copper jacketed soft point projectile, 5.56 mm jacketed soft point projectile and 10 mm Auto jackets soft point projectile. Structures illustrated in FIGS. 3–5 that are similar to those illustrated and described in FIGS. 1 and 2 are identified by like reference numerals.

The projectile 42 illustrated in FIG. 4 is a jacketed hollow point projectile. The nose portion 41 includes a rearwardly extending, forwardly open cylindrical cavity 43. Optionally, the nose portion 32 of metallic jacket 12 extends into the open cylindrical cavity 43. One exemplary caliber for this projectile is a 9 millimeter Luger copper jacketed hollow point bullet.

FIG. 5 illustrates a partition hand gun projectile 44. A generally H-shaped, partition metallic jacket 46 has a centrally disposed partition portion 47 separating a rear cavity 48 from a forward cavity 50. Both the rear cavity 48 and the forward cavity 50 are filled with the metallic core material 16. A closure disk 34 may be press-fit to the heel portion 24 of the metallic jacket 46 to retain the metallic core material 16 in the rearward cavity 48.

The projectiles of the invention are suitable for use with any conventional cartridge, including without limitation, center-fire pistol, center-fire rifle, center-fire revolver and rim-fire. The projectiles are not limited to specific calibers and the essentially pure tin cores of the invention are suitable for any jacketed projectile presently having a metallic lead core.

Projectiles of a size effective to be fired from a pistol utilizing a center-fire cartridge range in size from 0.25 caliber to about 0.458 caliber and projectiles of a size effective to be fired from a rifle utilizing a center-fire cartridge range in size from 0.22 caliber to about 0.50 caliber. Projectiles for rim-fire cartridges are typically 0.22 caliber for both pistol and rifle.

While the projectiles of the invention are particularly designed to be at least partially encased within a metal jacket, it is within the scope of the invention to form unjacketed projectiles from the essentially pure tin material disclosed hereinabove, particularly for firing from a pistol and additionally from a shotgun.

FIG. 7 illustrates in partial perspective view and partial cross-sectional representation a shotgun bullet ("slug") in accordance with the invention. A projectile 60 is cup-shaped and formed of essentially pure tin. A nose portion 61 is substantially hemispherical with a hollow point 62. As best viewed in FIG. 8, the diameter and depth of a cylindrical aperture forming the hollow point 62 can be varied to affect the degree of slug upset against target media.

Alternatively, or in addition, the nose portion of the slug can be notched to affect slug upset or fragmentation.

With reference to FIG. 7, rearward of the hemispherical nose portion 61 is a cylindrical body 63. The cylindrical body 63 is of an outer diameter effective to match the bore diameter of the shotgun barrel through which the slug is to be fired. The outer surface of the cylindrical body 63 contains spiral grooves 64 which allow for slug material deformation when fired through barrels with choke constrictions tighter than bore diameter. The cross sectional thickness of the cylindrical body 63 is preferably greater adjacent the nose portion 61 than at the heel portion 66. This slight taper provides greater integrity on target impact and improved accuracy gained from the center of gravity being closer to the nose.

In accordance with one method of manufacture, the essentially pure tin is extruded and cut to form right cylinders, which are subsequently swaged to a shape substantially as shown in FIG. 7. Because the density of tin is 63% that of lead, the projectile weight is less than that of a lead slug of the same dimensions. Energy levels comparable to a lead slug of equal dimensions can be obtained with the tin slug by launching the slug at a higher velocity. Optionally, the tin slug can be made longer to obtain similar projectile weight to that of the lead slug, and launched at a similar velocity.

FIG. 9 illustrates in cross sectional representation a second shotshell tin projectile 70. This projectile shape is a solid sphere of diameter matching the bore diameter. Being a sphere without any cavities, weight is maximized. Additionally, no in-flight projectile tumbling will occur with a spherically shaped projectile. Note that in-flight projectile tumbling degrades accuracy.

These slugs would also be applicable in muzzle loading applications.

The advantages of the invention will become more apparent from the examples that follow.

EXAMPLES

Example 1

9 millimeter Luger copper jacketed soft point projectiles, of the type illustrated in FIG. 3, were manufactured with an essentially pure tin core and firing tests were performed using a 9 millimeter Luger SAAMI (Sporting Arms and Ammunition Manufacturers Institute) standard test barrel. All tested bullets were found to possess optimum interior and exterior ballistic properties in addition to a predictable bullet flight, accuracy and low ricochet potential. Due to the density of tin being lower than that of lead, the 9 millimeter Luger projectiles of the invention weighed an average of 105 grains, compared to a conventional lead core 9 millimeter Luger bullet of similar design that weighed an average of 147 grains.

Example 2

40 caliber Smith & Wesson copper jacketed soft point projectiles were manufactured with an essentially pure tin core. Firing tests were performed with these bullets using a 40 Smith & Wesson SAAMI standard test barrel. All bullets were found to possess optimum interior and exterior ballistic properties in addition to a predictable bullet flight, accuracy and low ricochet potential. Due to the density of tin being lower than that of lead, the 40 S&W projectiles of the invention had an average bullet weight of 140 grains as compared to a conventional 40 S&W designed with the same dimensions having an average bullet weight of 180 grains.

Example 3

9 millimeter Luger copper jacketed hollow point projectiles, of the type illustrated in FIG. 4, were manufactured with an essentially pure tin core. Firing the projectiles from a 9 millimeter Luger standard test barrel demonstrated that all bullets had optimum interior and exterior ballistic properties in addition to a predictable bullet flight, accuracy and low ricochet projectile. The 9 millimeter jacketed hollow point projectiles of the invention had an average weight of 104 grains compared to 147 grains for comparable standard production material 9 millimeter Lugerjacketed hollow point bullets.

Ten of the bullets of the invention were loaded in a standard 9 millimeter Luger shell case with Ball Powder® propellant ("BALL POWDER" is a trademark of Primex Technologies, Inc., St. Petersburg, Fla. The propellant is available from Olin Corporation, East Alton, Ill.) to a loaded round length of 1.115 inches±0.010 inch. The projectile velocity on firing was 1,100 feet per second±20 feet per second.

In accordance with Federal Bureau of Investigation ammunition test protocol, five of the bullets of the invention were fired into a block of gelatin from a distance of 10 feet. The bullets had an average velocity of 1,144 feet per second and penetrated the gelatin to an average depth of 11.15 inches.

Another five shots were fired at a gelatin block covered with a layer of denim covered by a layer of down. The bullets were fired from a distance of 10 feet and achieved an average velocity of 1,160 feet per second and an average penetration depth of 11.375 inches.

Both the velocity and the depth of penetration of the bullets of the invention compare very favorably to standard lead core projectiles. Other properties including upset diameter and weight retention were comparable to that of conventional lead projectiles.

Example 4

9 millimeter Luger copper jacketed soft point projectiles manufactured with an essentially pure tin core, as described in Example 1, were loaded in standard 9 millimeter shells as described in Example 3 and compared to a 9 millimeter Luger zinc core bullet of the type disclosed in U.S. Pat. No. 5,679,920. The average weight of the bullet of the invention was 105 grains and of the zinc base bullet, 100 grains. When fired at a temperature of 70° F., the bullets of the invention had an average velocity of between 1,155 and 1,245 feet per second. The zinc core bullets had an average weight of between 1,226 and 1,252 feet per second.

The accuracy of the bullets was evaluated. 5 shots were fired from each of three different 9 millimeter Luger test barrels at a target 50 yards away. Each test was repeated five times and the extreme spread, in inches, between each set of 5 shots recorded in Table 2. The extremely high accuracy of the projectiles of the invention approach match grade.

TABLE 2

| Test # | BBL #1 | BBL #2 | BBL #3 |
|---|---|---|---|
| Tin Core 9 mm Jacketed Soft Point | | | |
| 1 | 0.94 | 1.22 | 1.02 |
| 2 | 2.29 | 1.96 | 0.59 |
| 3 | 1.40 | 0.92 | 0.87 |
| 4 | 1.40 | 1.64 | 0.72 |
| 5 | 0.88 | 0.74 | 0.84 |
| Average | 1.38 | 1.30 | 0.81 |
| Zinc core 9 mm Jacketed Soft Point | | | |
| Test # | BBL #1 | BBL #2 | BBL #3 |
| 1 | 2.41 | 1.93 | 0.98 |
| 2 | 2.34 | 1.30 | 1.55 |
| 3 | 1.30 | 1.23 | 1.72 |
| 4 | 0.82 | 1.38 | 1.06 |
| 5 | 1.52 | 1.34 | 1.41 |
| Average | 1.68 | 1.44 | 1.34 |

BBL= 9 millimeter Luger test barrel.

The ricochet potential was evaluated by firing five essentially pure tin core projectiles and five zinc core projectiles at a one quarter inch soft steel plate target having a Brinnel hardness of between 55 and 60 HB. The target placed 50 feet in front of a 9 millimeter Luger test barrel at a zero degree offset angle. Table 3 records the results of impact between projectile and target.

TABLE 3

| SHOT | NOTES |
|---|---|
| | Essentially Pure Tin Core Projectiles |
| 1 | BJ was found 10' from plate. Tin core found 5' in front of plate. Small tin fragments found up to 25' from plate |
| 2 | BJ found 11' from plate. Tin core found 7' from plate. Small fragments all within 20' from plate. |
| 3 | BJ found 10' from plate. Tin core found 9' from plate. No fragments past 20'. |
| 4 | BJ found 10.5' from plate. Tin core found 10' from plate. All fragments within 25' of plate |
| 5 | BJ found 10' from plate. Tin core found 12" from plate. All fragments within 25' of plate. |
| | Zinc Core Projectiles |
| 1 | Two small zinc fragments 44' from plate. BJ found 26' from plate. Most particles 20' from plate |
| 2 | BJ found 18' from plate. Small fragments up to 40' from plate. |
| 3 | BJ found 27' from plate. Small fragments up to 40' from plate |
| 4 | BJ not found. Small pieces of bullet jacket and zinc particles up to 40' from plate |
| 5 | BJ not found. Small pieces of bullet jacket and zinc particles up to 40' from plate |

*BJ= Bullet Jacket.
*'= Distance in feet.

Example 5

Tin "cup" slugs as depicted in FIG. 7 were manufactured from essentially pure tin. A 12 gauge size (i.e., approximately 0.727' diameter) was selected to be tested. Because of the lower density of tin, the resulting slug weight was 281 grains, compared to 438 grains weight of the lead slug of same dimensions. The lead slugs and tin slugs were loaded in standard 12 gauge 2¾' shellcases. In order to achieve comparable muzzle energies of around 1800 ft-lbs, the tin slug was loaded to a velocity of 1680 fps, while the lead slug was loaded to a velocity level of 1370 fps. Consistent interior ballistics were achieved with the tin slug configuration. Predictable bullet path and greater penetration through 10% Ordnance gelatin was observed for the tin slug as compared to lead slugs of comparable size. In addition, the tin slugs were a non-toxic projectile.

It is apparent that there has been provided in accordance with the present invention a lead-free projectile that fully satisfies the objects, means and advantages set forth hereinabove. While the invention has been described in combination with embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

We claim:

1. A lead-free projectile used in a cartridge having a powdered chemical propellant consisting of essentially pure tin having a tin content of at least 99.8%, by weight, a yield strength of 11.0 MPa or less, and a hardness of less than 5 HB and formed to an aerodynamic profile.

2. The lead-free projectile of claim 1 wherein said essentially pure tin has a maximum of 0.1%, by weight, of any one alloying addition.

3. The lead-free projectile of claim 2 wherein a maximum zinc content is less than 0.005%, by weight.

4. The lead free projectile of claim 3 wherein said essentially pure tin contains, by weight, a maximum of 0.04% antimony,
a maximum of 0.05% arsenic,
a maximum of 0.030% bismuth,
a maximum of 0.001% cadmium,
a maximum of 0.04% copper,
a maximum of0.015% iron,
a maximum of 0.05% lead,
a maximum of 0.01% sulfur,
less than 0.005% zinc, and
a maximum of 0.01% (nickel+cobalt).

5. The lead-free projectile of claim 1 wherein said tin content is at least 99.85%, by weight.

6. The lead-free projectile of claim 1 wherein said hardness is between 3 HB and 5 HB.

7. The lead-free projectile of claim 6 wherein said essentially pure tin is Grade A tin.

* * * * *